US006358166B1

(12) United States Patent
Yu

(10) Patent No.: US 6,358,166 B1
(45) Date of Patent: Mar. 19, 2002

(54) HOCKEY STICK

(76) Inventor: Kuo-Pin Yu, No. 6, Lane 477, Sec. 2, Feng-Shyn Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/479,056

(22) Filed: Jan. 7, 2000

(51) Int. Cl.[7] ..... A63B 59/12; A63B 59/14
(52) U.S. Cl. ..... 473/561
(58) Field of Search ..... 473/560–563, 473/567, 549, 319, 320

(56) References Cited

U.S. PATENT DOCUMENTS 5,217,221 A * 6/1993 Baum ..... 473/561
5,333,857 A * 8/1994 Lallemand ..... 473/561
5,439,215 A * 8/1995 Ratchford ..... 473/561
6,033,328 A * 3/2000 Bellefleur et al. ..... 473/561
6,224,505 B1 * 5/2001 Burger ..... 473/561

* cited by examiner

*Primary Examiner*—Mark S. Graham
(74) *Attorney, Agent, or Firm*—Browdy and Neimark P.L.L.C.

(57) ABSTRACT

A hockey stick comprises a shaft and a blade fastened with one end of the shaft. The shaft is formed of a shell and a wooden film covering the shell for mitigating shock and preventing static.

15 Claims, 4 Drawing Sheets

HOCKEY STICK

FIELD OF THE INVENTION

The present invention relates generally to a hockey stick, and more particularly to a hockey stick which is made of a fiber-reinforced plastic material or an aluminium alloy and is provided with a woody appearance.

BACKGROUND OF THE INVENTION

The hockey stick is traditionally made of a wooden material and is vulnerable to wear, especially the shaft of the hockey stick which is apt to fatigue or severance due to the stress and the strain exerting on the shaft during the hockey game. In light of such drawbacks as described above, the hockey stick is made of the aluminium alloy or the fiber-reinforced plastic material. Such an improved hockey stick tends to bring about a considerable shock wave instantaneously to inflict a wound on the hands holding the shaft of the hockey stick. The hockey stick of the fiber-reinforced plastic material is prone to bring about the static resulting from friction, flexure, and wind shear.

SUMMARY OF THE INVENTION

The primary objective of the present invention is to provide an improved hockey stick which is free from the drawbacks of the prior art hockey sticks described above.

The hockey stick of the present invention comprises a shaft and a blade fastened with one end of the shaft. The shaft is covered with a wooden film having a pliability and a predetermined wood grain. The shaft is resistant to wear, and shock, and is free from static.

The features and the functions of the present invention will be more readily understood upon a thoughtful deliberation of the following detailed description of the embodiments of the present invention with reference to the accompanying drawings.

DETAILED DESCRIPTION OF THE INVENTION

Figure 1:
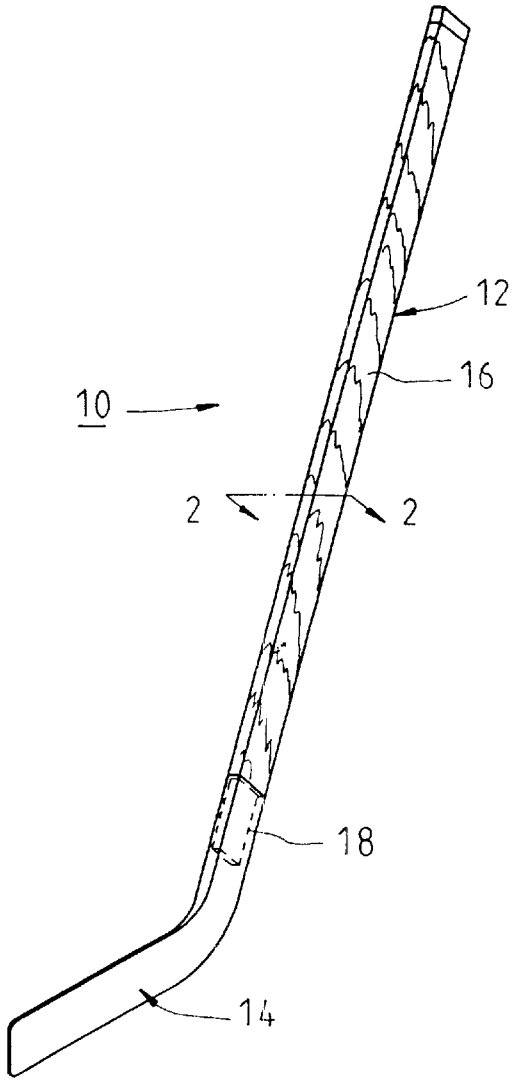
FIG. 1 shows a perspective view of a first preferred embodiment of the present invention.

As shown in FIG. 1, a hockey stick 10 of the first preferred embodiment of the present invention comprises a shaft 12, and a blade 14 fastened with one end of the shaft 12.

The shaft 12 has a long body 16 and a fastening end 18 for fastening the blade 14.

As shown in Figs., body 16 has a predetermined length and a hollow tube 19 which is rectangular in its cross section and is made of a fiber-reinforced plastic material or an aluminum alloy. The shell 19 is covered with a wooden film 20 which has a thickness of 0.1 mm or so and is wound around the peripheral surface of the shell 19. The thickness of the wooden film 20 is in face in the range of 0.05 mm–0.3 mm.

Figure 2:
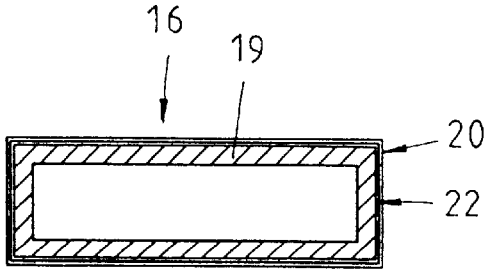
FIG. 2 shows a sectional view taken along the direction indicated by a line 2—2 as shown in FIG. 1.
Figure 3:
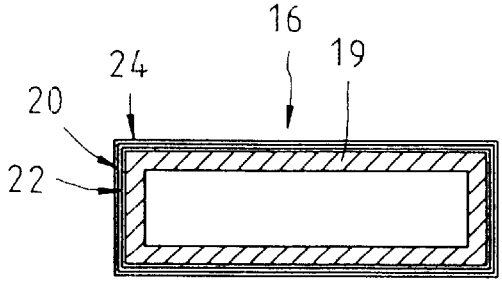
FIG. 3 shows a sectional view of a second preferred embodiment of the present invention, with the sectional view being taken along the direction similar to the line 2—2 of FIG. 2.

As shown in FIG. 2, the wooden film 20 is provided in the inner side thereof with a fiber-reinforced plastic fabric plate 22 (such as a glass fiber fabric plate impregnated with epoxy resin) attached thereto so as to facilitate the winding of the wooden film 20 around the shaft 12. The wooden film 20 may be covered with a transparent fiber-reinforced plastic layer 24, such as a glass fiber layer impregnated with epoxy resin, to protect the wooden film 20, as illustrated in FIG. 3.

Figure 4:
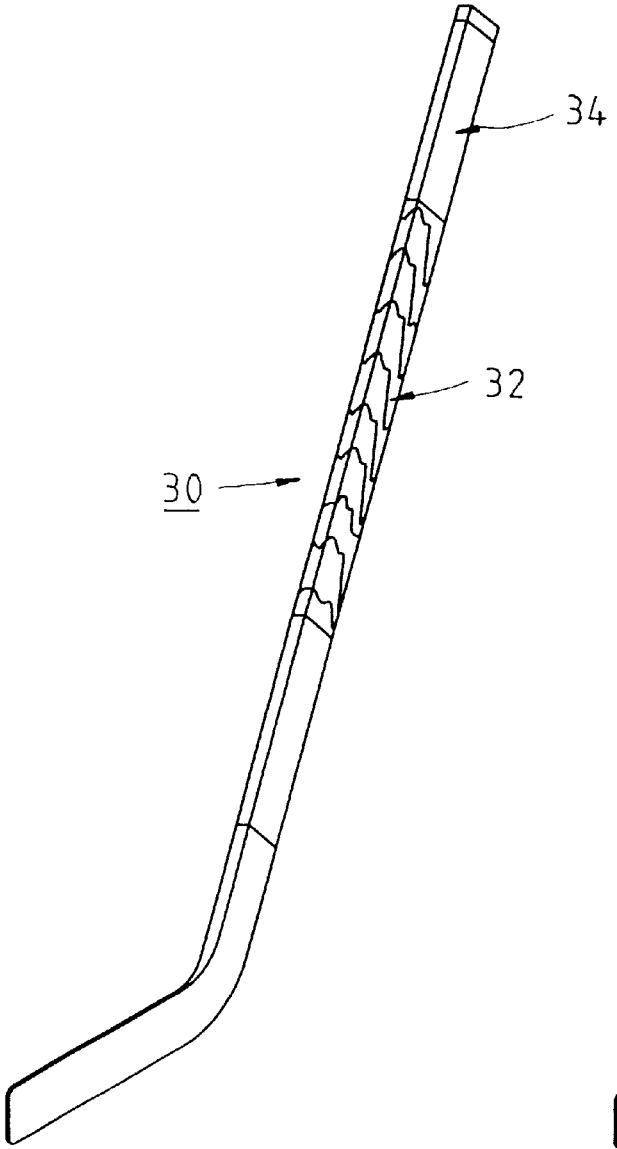
FIG. 4 shows a perspective view of a third preferred embodiment of the present invention.

As shown in FIG. 4, a hockey stick 30 of the third preferred embodiment of the present invention is basically similar in construction to the hockey stick 10 of the first preferred embodiment described above, with the difference being that the former comprises a wooden film 32 which covers only the midsegment of the body 34.

Figure 5:
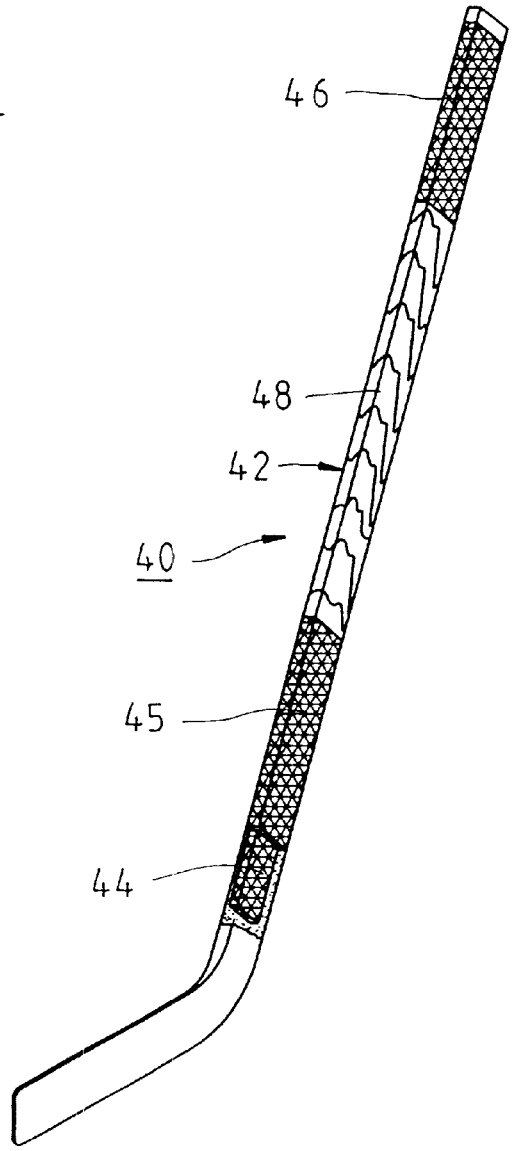
FIG. 5 shows a perspective view of a fourth preferred embodiment of the present invention.

As shown in FIG. 5, a hockey stick 40 of the fourth preferred embodiment of the present invention is characterized by a body 42 which is covered in the upper segment thereof and the lower segment thereof, including the fastening end 44, by a fiber-woven layer 45, 46, which may be a fiber-woven tube or a fiber woven cloth. The body 42 is covered in the midsegment thereof by a wooden film 48. The fiber-woven layers 45 and 46 are intended to reinforce the structural strength of the body 42.

Figure 6:
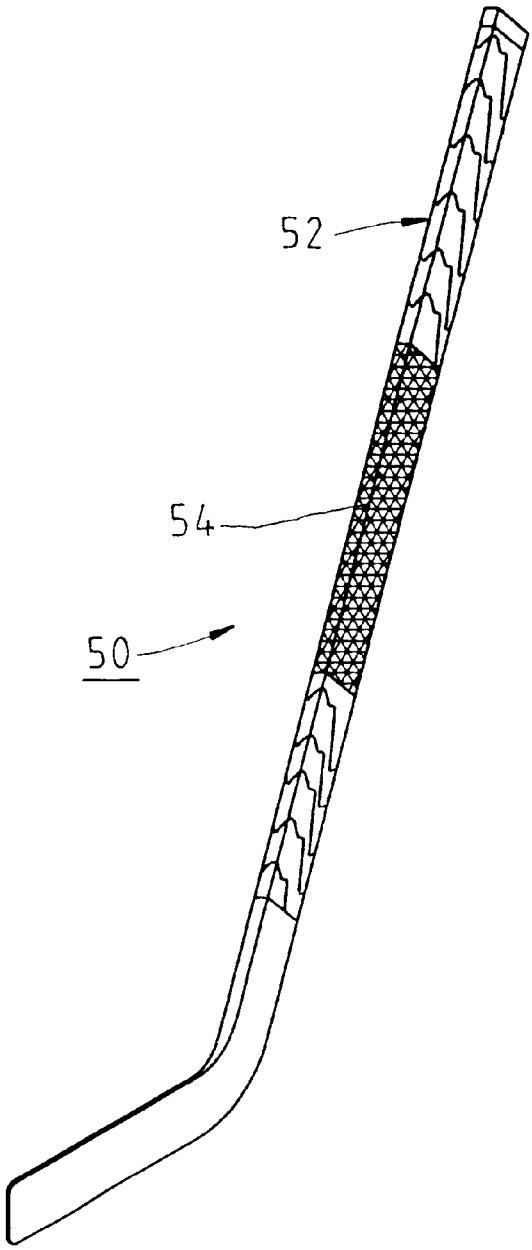
FIG. 6 shows a perspective view of a fifth preferred embodiment of the present invention.

As shown in FIG. 6, a hockey stick 50 of the fifth preferred embodiment of the present invention is similar in construction to the hockey stick 10 of the first preferred embodiment described above, except that the former has a body 52 which is provided in the midsegment thereof with a fiber-woven layer 54, which is formed of a fiber-woven tube or a fiber-woven cloth.

Figure 7:
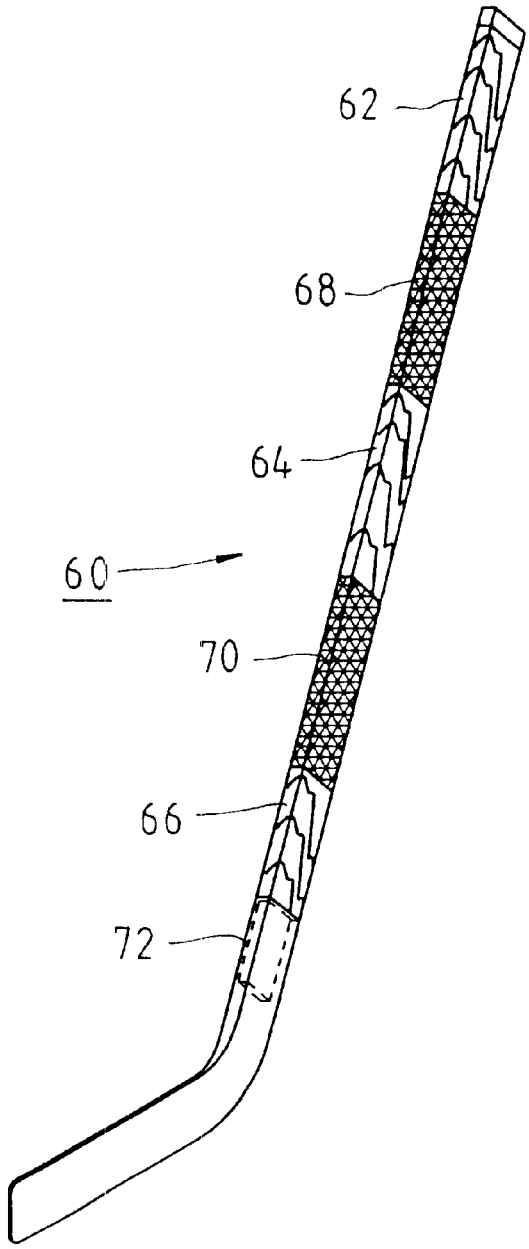
FIG. 7 shows a perspective view of a sixth preferred embodiment of the present invention.

As shown in FIG. 7, a hockey stick 60 of the sixth preferred embodiment of the present invention has a body which is provided with three wooden film sections 62, 64 and 66, and two fiber-woven sections 68 and 70. The body has a fastening end which is covered with a wooden film 72.

Figure 8:
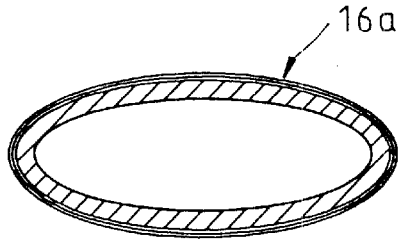
FIG. 8 shows a sectional view of a seventh preferred embodiment of the present invention, with the sectional view being taken along the direction similar to the line 2—2 of FIG. 2.
Figure 9:
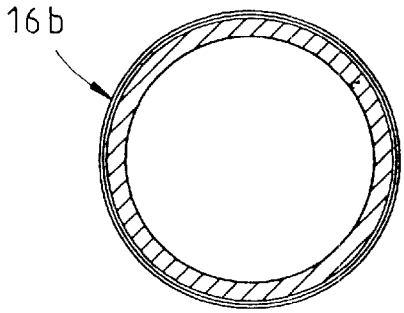
FIG. 9 shows a sectional view of an eighth preferred embodiment of the present invention, with the sectional view being taken along the direction similar to the line 2—2 of FIG. 2.
Figure 10:
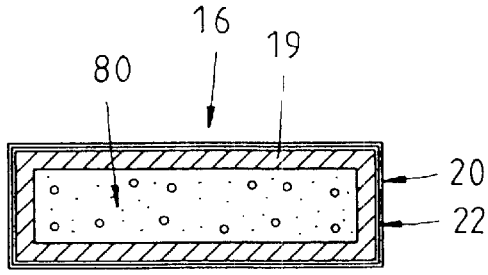
FIG. 10 shows a sectional view of a ninth preferred embodiment of the present invention, with the sectional view being taken along the direction similar to the line 2—2 of FIG. 2.

As shown in FIGS. 8 and 9, the bodies of the hockey sticks of the embodiments of the present invention are not rectangular in cross section. The bodies 16*a* and 16*b* are oval or round in cross section. As shown in FIG. 10, the shell 19 of the first preferred embodiment encloses a core 80 which is formed of a plastic foam material and is intended to absorb shock.

The hockey stick of the present invention is covered with the wooden film in various densities to bring about an excellent shock-absorbing effect, thanks to the differences in the shock-wave transmission rate.

The shaft of the hockey stick of the present invention is provided with an outer layer having a woody grain which gives an added user-friendly feeling.

The hockey stick of the present invention is covered with the wooden film and the glass fiber layer, which prevent the occurrence and the transmission of static.

What is claimed is:

1. A hockey stick comprising:

a shaft having a longitudinal axis; and a blade fastened with one end of said shaft;

wherein said shaft is formed of a hollow fiber-reinforced plastic tube and a wooden film wound around said tube;

wherein said wooden film is provided on an inner side thereof with a fiber-reinforced plastic plate impregnated with epoxy resin attached thereto to facilitate engagement around the tube, and wherein said wooden film is provided in an outer side thereof with a glass fiber layer attached thereto.

2. The hockey stick as defined in claim 1, wherein said wooden film has a thickness ranging between 0.05 mm and 0.3 mm.

3. The hockey stick as defined in claim 1, wherein said tube contains a core of a plastic foam material.

4. The hockey stick as defined in claim 1, wherein said one end of said shaft is covered with a wooden film.

5. The hockey stick as defined in claim 1, wherein said one end of said shaft is covered with a fiber-woven layer.

6. A hockey stick comprising:

a shaft having a longitudinal axis; and a blade fastened with one end of said shaft;

wherein said shaft is formed of a hollow fiber-reinforced plastic tube and a wooden film wound around a predetermined segment of said tube;

wherein said wooden film is provided on an inner side thereof with a fiber-reinforced plastic plate impregnated with epoxy resin attached thereto to facilitate engagement around the tube, and wherein said wooden film is provided in an outer side thereof with a glass fiber layer attached thereto.

7. The hockey stick as defined in claim 6, wherein said wooden film has a thickness ranging between 0.05 mm and 0.3 mm.

8. The hockey stick as defined in claim 6, wherein said tube contains a core of a plastic foam material.

9. The hockey stick as defined in claim 6, wherein said one end of said shaft:is covered with a wooden film.

10. The hockey stick as defined in claim 6, wherein said one end of said shaft is covered with a fiber-woven layer.

11. A hockey stick comprising:

a shaft having a longitudinal axis; and a blade fastened with one end of said shaft;

wherein said shaft is formed of a hollow fiber-reinforced plastic tube, a wooden film wound around one segment of said tube, and a fiber-woven layer covering another segment of said tube;

wherein said wooden film is provided on an inner side thereof with a fiber-reinforced plastic plate impregnated with epoxy resin attached thereto to facilitate engagement around the tube, and wherein said wooden film is provided in an outer side thereof with a glass fiber layer attached thereto.

12. The hockey stick as defined in claim 11, wherein said wooden film has a thickness ranging between 0.05 mm and 0.3 mm.

13. The hockey stick as defined in claim 11, wherein said tube contains a core of a plastic foam material.

14. The hockey stick as defined in claim 11, wherein said one end of said shaft is covered with a wooden film.

15. The hockey stick as defined in claim 11, wherein said one end of said shaft is covered with a fiber-woven layer.

* * * * *